United States Patent [19]

Grevich

[11] 4,043,709

[45] Aug. 23, 1977

[54] ADJUSTABLE STOP ASSEMBLY

[75] Inventor: John J. Grevich, Star Prairie, Wis.

[73] Assignee: Domain Industries, Inc., New Richmond, Wis.

[21] Appl. No.: 606,651

[22] Filed: Aug. 21, 1975

[51] Int. Cl.[2] ..... F04B 17/00; F04B 35/00

[52] U.S. Cl. ..... 417/404; 91/277; 92/13.4; 92/13.5

[58] Field of Search ..... 417/402–404, 417/326, 339, 344–347, 393, 396, 397; 91/277, 306; 60/369, 370; 200/47, 82 A, 82 C, 153 T, 61, 42; 92/85 A, 13.4, 13.5, 13.7; 251/60

[56] References Cited

U.S. PATENT DOCUMENTS

| | | | |
|---|---|---|---|
| 3,019,734 | 2/1962 | Bourquin | 417/344 |
| 3,070,023 | 12/1962 | Glasgow | 417/397 |
| 3,207,083 | 9/1965 | Lohry et al. | 417/454 |
| 3,407,710 | 10/1968 | Weiss | 92/13.8 |
| 3,605,567 | 9/1971 | Cooper | 92/13.4 |
| Re. 25,873 | 10/1965 | Rutherford | 417/404 |

*Primary Examiner*—John J. Vrablik
*Assistant Examiner*—Edward Look
*Attorney, Agent, or Firm*—H. Dale Palmatier

[57] ABSTRACT

In a liquid product measuring pump driven by an air motor having air valve controls for reversing the reciprocating motion of the air motor at the end of the stroke for controlling the liquid product measuring, an adjustable stop assembly including a quickly replaceable stop bar with an extendible threaded rod therein, the rod being minutely adjustable by an insert fitting on the mounting for the stop bar.

7 Claims, 6 Drawing Figures

53
52
50
42
48
49
47
46
56.2
56.1
56
55
45
57
41
38
58.3
58.4
STATIONARY MOUNTING BRACKET 53.3
53
53.1
52.1
52
44
52.2
50
42
43
52.3
48
44.1
52.4
53.2
56.1
53.4
56
55
49.2
54
38.1
11
57.1
57
58.2
58
41.1
43
58.1
41
38
45
58.3
58.4

FIG. 4
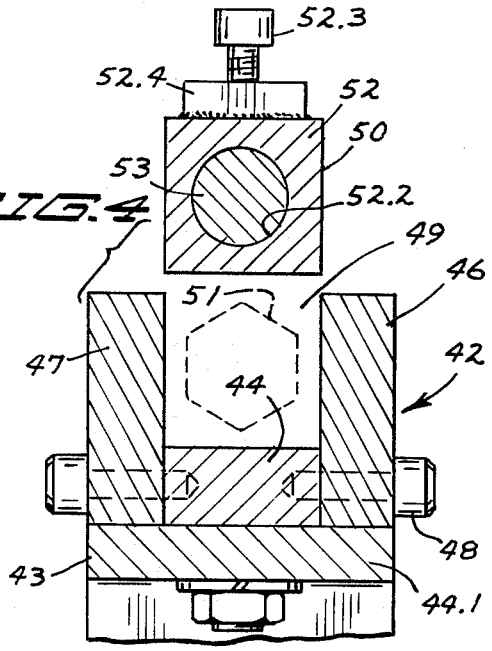
FIG. 5
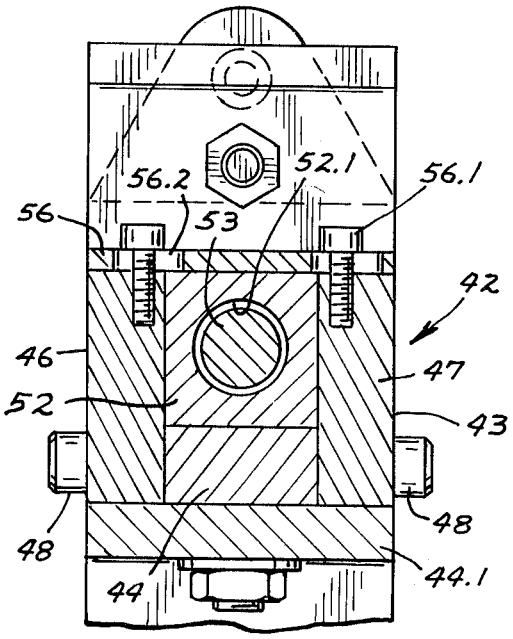
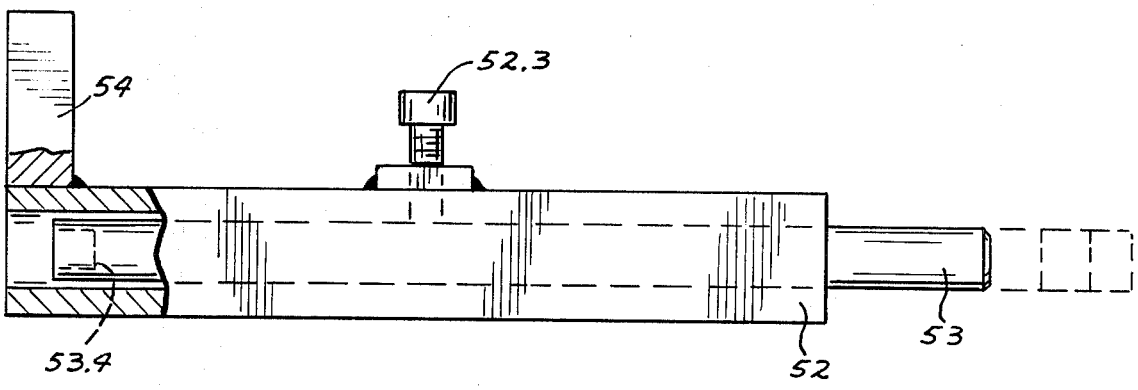
FIG. 6

ADJUSTABLE STOP ASSEMBLY

BACKGROUND OF THE INVENTION

Filling of liquid product into containers in a high speed production line involves many variables. Such liquid product may consist of paint, oil, solvents and many others which vary widely in viscosity.

Machinery for filling such containers must be adapted for quick change over from and to gallons and quarts and other standard units of U.S. liquid measure, gallons and quarts and other standard units of British Imperial liquid measure, and liters and dekaliters and other standard units in the metric system of measures. Liquids of different viscosities measure differently than each other. For instance, in measuring with a reciprocating pump, in order to obtain a full U.S. gallon measure of thick paint, the stroke length of the piston must be changed after using the same pump to measure a full gallon of wood stain.

Other prior apparatus have been used for changing the stroke lengths of the measuring pump. Stops have been utilized, and a number of such stops have been incorporated into a turret-like control, but such an arrangement has a very limited number of quantity adjustments — only 4 or 6 positions on the turret.

SUMMRY OF THE INVENTION

The product-measuring pump is reciprocated by an air operated reciprocating motor. The pressure and exhaust of the air motor are controlled by air valves which are operated by the slide which moves with the piston of the product-measuring pump. Such valves are operated to cause the slide and piston of the pump to stop and reverse directions at the proper instant when a predetermined quantity of the liquid product has been measured.

At one end of the stroke, the slide operates one such air valve through an adjustable stop which is quickly and readily replaceable. The adjustable stop is simple and inexpensive and may be provided in many lengths and may be minutely adjusted to obtain the precise length of stroke of the piston while the machine is operating.

For replacing, the adjustable stop is merely released and lifted out of its seat, and a replacement stop is dropped into the seat. The adjustable stop incorporates a threaded extension rod, one end of which serves to form one end of the adjustable stop, and the other end of the extension rod being provided with a fitting so that a wrench can be readily and easily inserted for turning the extension rod during operation of the machine.

BRIEF DESCRIPTION OF THE DRAWINGS

FIG. 1 is a side elevation view of the measuring pump, and being partly broken away for clarity of detail.

FIG. 4 is a detailed transverse section view taken approximately at 4—4 in FIG. 3 and showing the insert of the adjustable stop removed from the seat.

FIG. 5 is a detailed section view taken approximately at 5—5 in FIG. 3.

FIG. 6 is a side elevation view of the removable adjustable stop.

DETAILED DESCRIPTION OF THE INVENTION

Figure 2:
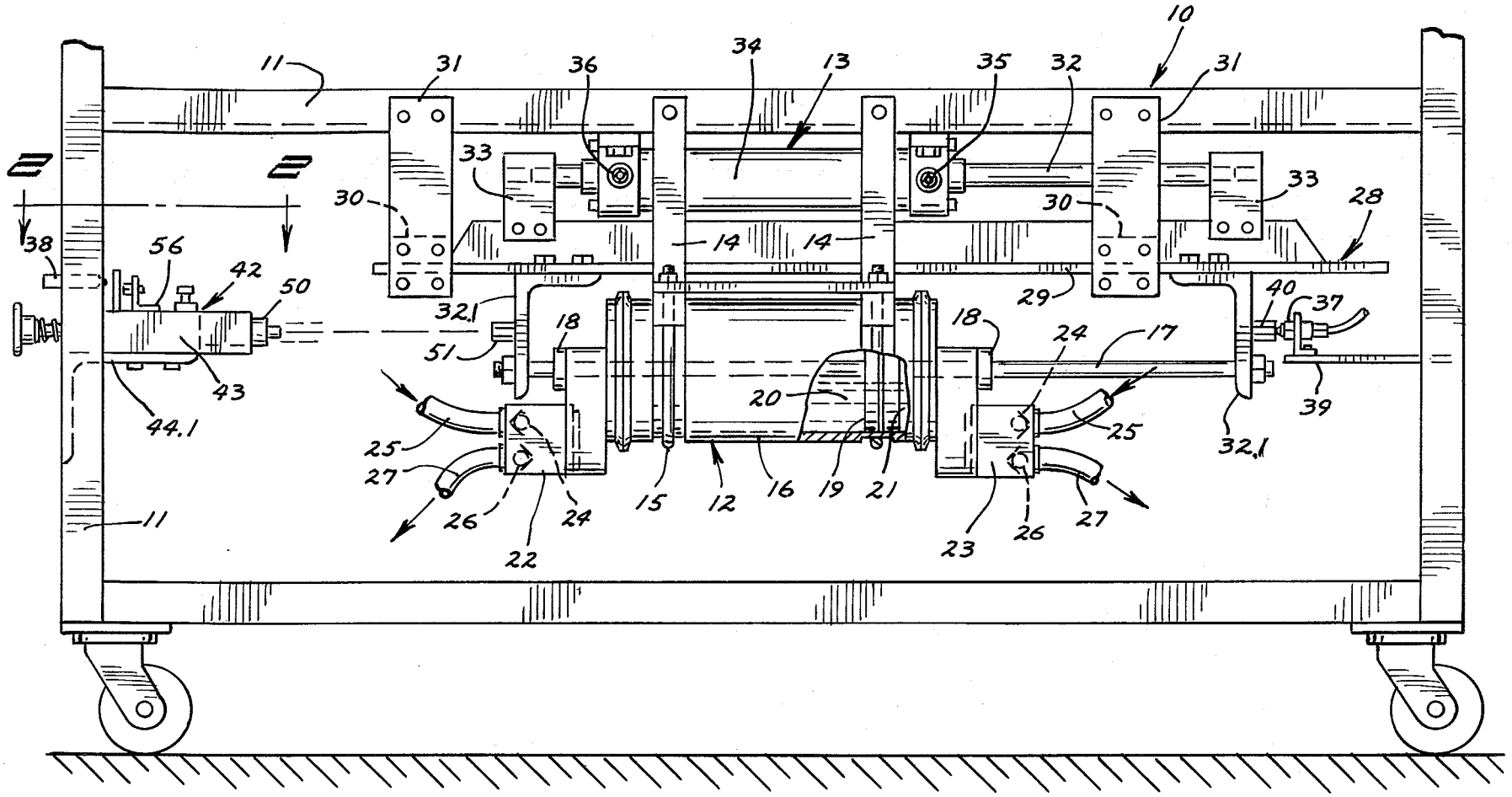
FIG. 2 is a detailed top plan view of the adjustable stop mechanism as viewed at approximately 2—2 in FIG. 1.
Figure 2:
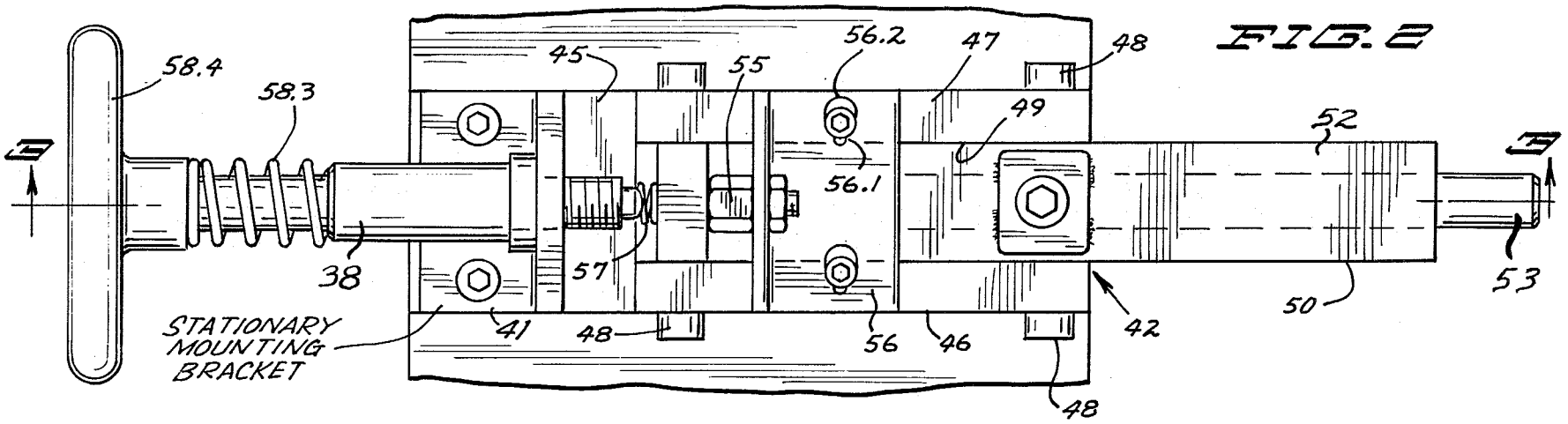
Figure 3:
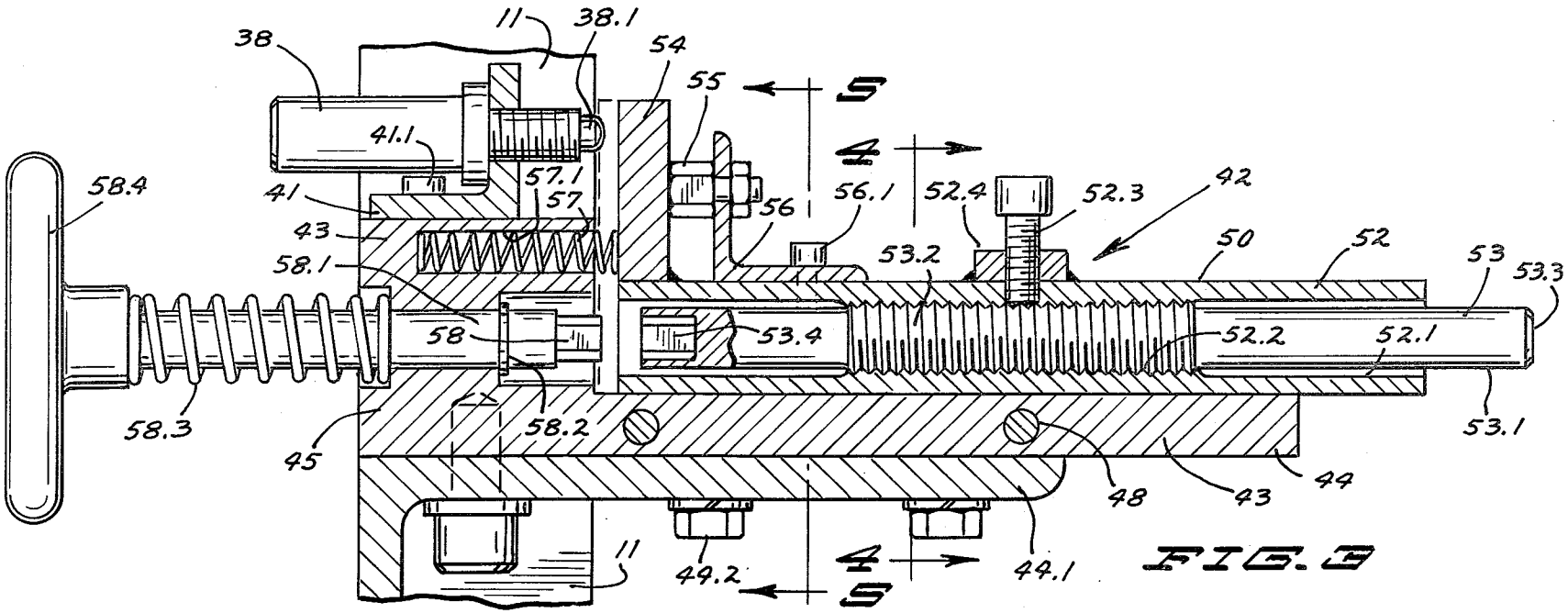
FIG. 3 is an enlarged detail section view taken approximately at 3—3 in FIG. 2.

One form of the invention is shown in the drawings and is described herein. The principal components of the machine for measuring predetermined quantities of liquid product are illustrated in the drawings and the machine is illustrated in FIG. 1 and indicated in general by numeral 10. The frame 11 mounts the liquid product measuring pump 12 and the double acting reciprocating air motor 13. The pump 12 is suspended on a rigid hanger bracket 14 and U-shaped clamps 15 which solidly mount the stationary cylinder 16 of the pump 12. A piston rod 17 extends longitudinally through the cylinder 16 and through suitable seals 18 at its opposite ends, and mounts the reciprocating piston 19 which produces the pumping of the liquid product and divides the interior of the cylinder 16 into separate pump chambers 20 and 21. The liquid product is measured in each of the pump chambers 20 and 21 during each reciprocating stroke of the piston 19 and rod 17, and the flow of the liquid product into and out of the chambers 20 and 21 is controlled by a pair of valve assemblies 22 and 23. The valve assemblies 22 and 23 are substantially identical to each other, and each incorporates an inlet check valve 24 allowing liquid product to be drawn into the chamber of the cylinder from supply ducts 25 which are connected to the valves. The supply ducts 25 may connect to any suitable source of supply of the liquid product, such as a tank or hopper.

Each of the valve assemblies 22 and 23 also includes an outlet check valve 26 permitting discharge of the liquid product from the pump during the corresponding stroke of the piston 19, and through the outlet or discharge ducts 27. The discharge ducts 27 will be directed to the filling stations of a container-filling machine, and may be provided with suitable nozzle heads or other liquid flow-directing apparatus so that the containers will be filled as the pump 12 is operated.

The piston rod 17 of the pump 12 is reciprocated by a slide which is indicated in general by numeral 28, and incorporates a slide bar 29 horizontally movable and slidable in slide bearings 30 suspended on brackets 31 from the frame 11. Angle brackets 32.1 are rigidly affixed to the slide bar 29 and rigidly affix the opposite ends of the piston rod 17 thereon.

The slide 29 is driven by the air motor 13 and is connected to the reciprocating piston rod 32 of the air motor by rigid brackets 33 respectively affixed to the piston rod 32 and to the slide 28.

The housing 34 of the air motor 13 is bolted to the frame 11, and the air motor is supplied with compressed air at its opposite ends through hoses 35 and 36 for producing the reciprocating movement of the piston rod 32. The air motor 13 is controlled by suitable valving and air circuits. Such air circuits include a pair of control valves 37 and 38 which are operated by movement of the slide 28 and produce the reversing of the air connections to motor 13 so as to accomplish the reversing of the direction of movement of piston rod 32. Valve 37 is affixed to a mounting bracket 39 on the frame 11. An operating lug 40 is affixed to the mounting bracket 32 to operate the air valve when the slide 28 moves to the right in FIG. 1.

The control valve 38 is also stationary with respect to frame 11 and is affixed on a stationary mounting bracket 41.

A highly adjustable stop assembly, indicated in general by numeral 42, is mounted on the frame 11 adjacent the air valve 38. The stop assembly 42 includes a rigid mounting 43 affixed upon an angle bracket 44.1 which is welded or otherwise affixed to the frame 11.

The mounting 43 includes a bottom plate 44, to which a bearing block 45 is formed integrally, and a pair of upright side plates 46 and 47 which are affixed as by screws 48 to the bottom plate 44. As best seen in FIG. 4, the upright side walls 46 and 47 and the bottom plate 44 cooperatively define an elongate recess 49 in the mounting 43 to provide a seat to slidably receive the adjustable stop bar 50.

The mounting 43 is affixed on the angle bracket 44.1 by cap screws 44.2 so that the end of the adjustable stop bar 50 is aligned with the rigid lug 51 on bracket 32 of slide 28. The air valve mounting bracket 41 is affixed on the mounting 43 and secured thereto as by screws 41.1.

The adjustable stop bar 50 has two principal parts, an elongate rigid and substantially square bar 52 and an elongate rigid rod 53. The bar 52 has an elongate passage 52.1 extending entirely therethrough. The internal passage 52.1 having opposite ends with a smooth bore, and the intermediate portion 52.2 of the passage being threaded. The bar 52 has a set screw 52.3 threaded into a nut 52.4 which is welded on the exterior of the bar.

The rigid rod 53 has smooth cylindrically surfaced end portions 53.1 and a threaded intermediate portion 53.2 threaded into the passage of the stop bar 52. The set screw 52.3 extends into the threaded passage 52.2 for locking the threaded rod 53 in fixed position. The threaded portions 52.2 and 53.2 are spaced inwardly from the ends of the bar 52 and rod 53 to keep the threads clean so that the rod may be readily adjusted without being impeded by paint or other materials which might collect and otherwise impede smooth and easy turning of the rod 53 in the stop bar.

The outer end 53.3 of the rod 53 provides an abutment surface to engage the slide 28 at the lug 51. The opposite end of the rod 53 has a hexagonal, non-circular socket 53.4 formed therein, to provide for turning and longitudinal adjustment of the rod 53.

At its inner end, the stop bar 52 has a rigid abutment 54 affixed as by welding at the upper side thereof. The abutment 54 confronts the push button 38.1 of the air valve 38 for operating the valve. The abutment 54 moves with the stop bar 52 between the push button of the air valve 38 and a stop lug 55 which is affixed on the crosshead 56 which retains the stop bar 52 in the recess 49 of the mounting. The crosshead 56 extends across the top face of the stop bar 52 and across the adjacent side walls 46 and 47 and is removably secured to the side walls 46 and 47 by screws 56.1 which extend through keyhole-shaped slots or openings 56.2 in the crosshead. It will therefore be seen that by simply loosening the screws 56.1 slightly, the crosshead 56 may be moved slightly to the side and lifted off the stop bar 52 to release it for quick and easy replacement of the stop bar with another similar one.

The bearing block portion 45 of the base plate 44 has a hole 57.1 with an open end confronting the abutment 54. A spring 57 is seated in the hole 57.1 and has its outer end bearing against the abutment 54 for normally returning the abutment 54 against the stop lug 55 when the slide 28 moves away from the stop assembly 42.

A non-circular, hexagonal insert fitting 58 is formed on the end of an adjustment shaft or rod 58.1 which is rotatably mounted in a bearing aperture in the bearing block portion 45 of the base plate 44. A retainer ring 58.2 prevents movement of the shaft 58.1 outwardly through the bearing aperture and a spring 58.3 normally urges the shaft 58.1 outwardly so that the retainer ring 58.2 will bear against the ledge at the inner side of the bearing block 45. A handle 58.4 on the shaft facilitates turning the insert fitting 58, and also facilitates pushing the insert fitting 58 forwardly and into the socket 53.4 of the rod 53. In the operation of the liquid product measuring pump, it will be understood that the pump may be called upon to measure widely changing quantities of the various liquid products being handled; and over a period of time, the exact quantities measured should be repeatable so that after a predetermined measure of a particular liquid product has been made, for filling certain containers, the same identical measure of that product can be made at various times in the future. In measuring such liquid products as paint, it has oftentimes been experienced that in order to give a full measure of paint in a container, it may be necessary to vary the quantity measured by the pump by a slight amount, and even though the consistency of various batches of the paint are essentially the same, paint of one color might measure differently than paint of other colors.

The pump 12 may be operated at one end only, or may be operated to measure the liquid product in both of the end chambers 20 and 21. On the other hand, the pump may be operated so that liquid product is only being measured in one end of the cylinder, such as in chamber 20.

In the position shown in FIG. 1, the slide and piston 19 are at the end of a reciprocating stroke and the lug 40 is in engagement with the air control 37 so that the connections to the air motor 13 are instantly changed. Therefore, the next movement of the slide 28 and piston 19 will be to the left as viewed in FIG. 1 so as to draw the liquid product through the valve 23 and into chamber 21; and simultaneously, the liquid product in chamber 20 is being expelled through the valve assembly 22 and outlet duct 27. Subsequently, when the slide causes operation of valve 38, expelling of liquid product from chamber 20 will be terminated and drawing of liquid product into chamber 21 will also be terminated. The slide will again reverse directions so as to start expelling liquid product from chamber 21 through valve 23 and through the corresponding duct 27 and liquid product will be drawn into the chamber 20 through the valve assembly 22 from duct 25.

In most operating situations of the pump 12, the piston 19 will not move through the full possible stroke of pump 12, but will have a stroke length somewhat shorter and will in most cases operate somewhat closer to one end of the cylinder 16 than to the other end. In most cases there is no particular need to operate the piston symmetrically about a mid-point of the cylinder. It has been found that, by slightly adjusting the location of the end of the stroke of the piston 19 at one end of the pump will adjust the volume of liquid product being measured in both of the chambers 20 and 21 during both of the strokes of the piston.

When the slide 28 moves to the left in FIG. 1, the lug 51 will engage the abutment surface 53.3 of the rod 53 and will cause the stop bar 52 and abutment 54 to move to the left against the pressure of spring 57 and subsequently engage the push button 38.1 of the air valve 38 so as to operate the valve which reverses the connections in the air circuit to motor 13, whereupon the direction of driving of slide 28 will be reversed and the slide will be moved to the right and the lug 51 will tend to draw from the stop bar. Spring 57 will move the stop bar and rod 53 with the lug 51 until the abutment 54 engages lug 55 on the crosshead 56, whereupon, stop bar 52 will move no farther in the recess 49 and the slide will simply pull away from the stop assembly 42. When the slide subsequently causes operation of valve 37 the motor 13 will be reversed again to reverse the action of the pump 12.

One important aspect of this invention is the fact that when a different quantity of liquid product is to be measured, the stop bar 52 is readily and easily lifted out of the recess 49 by the operator of the machine, after he has first released the crosshead 56, and the operator can immediately and very easily slip another stop bar 52 into the proper operating position so that a new measure, accurately adjusted, can be made of the liquid product. With the same liquid product being measured, the machine can very easily be changed over from quarts to gallons to Imperial gallons to liters, and to any other measure, simply by dropping a new or different stop bar into the recess 49. A minimum amount of down time of the machine is experienced. The same can be said when a different liquid product is to be measured by the pump 12. A particular stop bar 52, of a length previously adjusted for the particular liquid product and measuring a certain quantity can be readily and easily dropped into the recess 49 for immediately getting the correct measure to be produced by the pump 12. No time is required for a mechanic to take down any apparatus or to make any detailed or complicated adjustments. The down time can be absolutely minimized because the measure, from previous experience, can be immediately obtained.

After a change is made and a different stop bar 52, with the rod 53 already in place, has been made, production, filling containers, can start immediately. The first few containers filled with the liquid product will be closely watched and if any slight adjustment has to be made, the insert fitting 58 can be moved into the socket insert 53.4 of the rod 53 so that the rod can be revolved and moved longitudinally along the thread so that the proper measure obtained through the action of the pump can be slightly adjusted and improved.

Of course, a number of the stop bars 52 can be stored, as in a rack, near the machine, and may be suitably indexed and marked so that they may be quickly selected and placed into operating position in the mounting 43 so that the machine can quickly get back into operation after the change is made.

It is especially important that any minor adjustments that have to be made by slightly turning the rod 53 along its threaded portion can be made while the machine is in operation. After the slight adjustment is made, the spring 58.3 will simply withdraw the insert fitting 58 from the socket 53.4 and the machine will continue operating at the new adjusted condition. The set screw 52.3 can be tightened down so as to hold the rod 53 in the desired position.

In the event that it is desired to operate the pump with the piston 19 moving equal distance from a point midway between the ends of the cylinder 16, a similar stop assembly 42 can be added at the righthand end of the machine in FIG. 1 so as to provide for operation of valve 37 by means of a variable stop assembly substantially identical to that indicated by numeral 42. This symmetrical operation of the piston 19 in the cylinder 16 may be desirable in certain products which carry a substantial amount of gas in the liquid product which will escape in the course of pumping it, whereupon chambers 20 and 21 must be of equal size as the pumping takes place.

It will be seen that I have provided a new and improved adjustable stop assembly for varying the stroke length of a liquid product measuring pump and facilitating very quick and easy changing of the location of the end of the stroke of the reciprocating air motor and liquid pump for changing the measure of the liquid product. The stop bar may be readily and easily dropped into place so that a minimum of down time and a maximum of variable quantities being measured can be obtained. Minute adjustments in the quantity being measured can be made while the machine is running and immediately after the change over to a new quantity measure has been made, and as soon as the quantities being measured can be checked in the containers.

What is claimed is:

1. A stop apparatus to provide an extension between the frame and slide of a reciprocating liquid product-measuring pump for operating the air control valve of the reciprocating air motor to actuate the pump, comprising:

an elongate mounting extending in the direction of movement of the slide and having a longitudinally extending recesss defining a seat;

an elongate adjustable stop snugly but removably fitted in said seat and having oppositely facing abutment surfaces adjacent its opposite ends, the abutment surfaces being interposed between the air valve and portions of the frame and slide to operate the valve at a predetermined slide position, the stop including an adjustment rod threadedly mounted on the stop, one end of the rod comprising one of said abutment surfaces, the other end of the rod having a socket fitting, the end of the stop adjacent said socket fitting comprising the other of said abutment surfaces, an insert fitting slidable on the mounting and aligned with the rod for detachable telescopic union with the socket fitting for revolving the rod along the threads; and readily releasable means retaining the adjustable stop on the mounting.

2. A stop apparatus to provide an extension between the frame and slide of a reciprocating liquid product-measuring pump for operating the air control valve of the reciprocating air motor to actuate the pump, comprising:

an elongate mounting extending in the direction of movement of the slide and having a longitudinally extending recess defining a seat;

an elongate adjustable stop snugly but removably fitted in said seat and having oppositely facing abutment surfaces adjacent its opposite ends, the abutment surfaces being interposed between the air valve and portions of the frame and slide to operate the valve at a predetermined slide position, the stop including an adjustment rod threadedly mounted on the stop, one end of the rod comprising one of said abutment surfaces, the stop being longitudinally slidable in the seat for movement against and away from the air valve, a spring on the mounting and urging the stop away from the air valve, and a bumper on the mounting and confronting the stop to limit movement of the stop under influence of the spring;

readily releasable means retaining the adjustable stop on the mounting, the said releasable means includes a bar extending transversely across the recess and removably secured to the mounting for retaining the adjustable stop in the recess.

3. In a machine for measuring quantities of liquid product by means of a reciprocating pump, the piston and slide of which are operated by a double acting air motor having motor-reversing control valves on the frame to be operated at the ends of the strokes of the slide, a stop apparatus on the frame to intercept the slide and operate the air valve when engaged by the slide, the stop apparatus including a stationary seat and an elongate and readily replaceable stop removably mounted in the seat, the stop having a length different than the length of the seat and being aligned with the slide and valve for engagement therewith, the stop having a threaded extension to vary the length thereof, an extension-rotating fitting on the stop apparatus, and coupling means on the extension and fitting and connecting the fitting to the extension to move the extension along the threads, and means releasably securing the stop in the seat.

4. In a machine for measuring quantities of liquid product by means of a reciprocating pump, the piston and slide of which are operated by a double acting air motor having motor-reversing control valves on the frame to be operated at the ends of the strokes of the slide;

a stop apparatus on the frame for engagement by the slide to operate the air valve, the stop apparatus comprising:

a mounting affixed to the frame adjacent the air valve and having an elongate open-topped recess aligned with the slide and defining a seat;

an elongate stop bar slidably confined within the seat and having a valve-operating abutment adjacent one end of the bar and confronting the valve, the bar having a threaded passage extending longitudinally entirely therethrough;

a threaded rod in said passage and having one end extending beyond the stop bar and confronting the slide for engagement therewith, the other end of the rod having a non-circular fitting thereon for rotation with the rod;

a second elongate non-circular fitting longitudinally slidably mounted on the mounting in alignment with the rod for attachment thereto and facilitating minute threaded adjustment of the rod to vary the point of engagement with the slide, a spring on the mounting and urging the stop bar away from the control valve and in opposition to the valve-operating motion of the slide; and means retaining the stop bar on the mounting and also limiting motion of the stop bar under influence of the spring.

5. The invention according to claim 4 wherein said second elongate non-circular fitting includes a mounting shaft rotatably journaled in the bearing, and means for revolving the shaft and fitting, and spring means urging said shaft and fitting slidably in the mounting and away from the stop bar.

6. The invention according to claim 4 and said stop bar having a generally rectangular cross-sectional shape, the open topped recess in the mounting having a complementary shape to the shape of the stop bar and including opposite upstanding side walls substantially entirely confining the stop bar therein, and said retaining means including a rigid crosshead lying transversely across said recess for retaining the stop bar in said seat, said crosshead lying flush upon the side walls and having means readily releasably retaining the crosshead on said side walls, said crosshead having a stop lug confronting the abutment of said stop bar and restraining the stop bar in a direction away from the control valve.

7. A stop apparatus to provide an extension between the frame and slide of a reciprocating liquid product-measuring pump for operating the air control valve of the reciprocating air motor to actuate the pump, comprising:

an elongate mounting extending in the direction of movement of the slide and having a longitudinally extending recess defining a seat;

an elongate adjustable stop snugly but removably fitted in said seat and having oppositely facing abutment surfaces adjacent its opposite ends, the abutment surfaces being interposed between the air valve and portions of the frame and slide to operate the valve at a predetermined slide position, the stop including an adjustment rod threadedly mounted on the stop, one end of the rod comprising one of said abutment surfaces, said adjustable stop including an elongate stop bar engaging said seat and having an elongate passage extending longitudinally through the bar, said bar defining threads along said passage, the threads terminating at locations spaced inwardly from the ends of the bar and said adjustment rod having smooth surfaces peripheries adjacent opposite ends of the rod and a threaded intermediate portion spaced longitudinally inwardly from the opposite ends of the rod whereby the threaded portion of the bar and rod are confined and protected against spilled liquid product and other contaminants; and readily releasable means retaining the adjustable stop on the mounting.

* * * * *